US007895920B2

(12) United States Patent
Abunameh

(10) Patent No.: US 7,895,920 B2
(45) Date of Patent: Mar. 1, 2011

(54) OPEN END RATCHET WRENCH

(76) Inventor: Hani A. Abunameh, Amman (JO)

( * ) Notice: Subject to any disclaimer, the term of this patent is extended or adjusted under 35 U.S.C. 154(b) by 0 days.

(21) Appl. No.: 12/002,571

(22) Filed: Dec. 17, 2007

(65) Prior Publication Data

US 2009/0151518 A1 Jun. 18, 2009

(51) Int. Cl.
*B25B 13/46* (2006.01)

(52) U.S. Cl. ..... 81/58.2; 81/61

(58) Field of Classification Search ..... 81/58, 81/58.1, 58.2, 60–63.2, 129, 165
See application file for complete search history.

(56) References Cited

U.S. PATENT DOCUMENTS

| | | | | | |
|---|---|---|---|---|---|
| 915,443 | A * | 3/1909 | Jones | 81/62 |
| 1,123,958 | A * | 1/1915 | Vacareza | 81/62 |
| 1,196,416 | A * | 8/1916 | Aliff | 81/63.2 |
| 2,445,969 | A * | 7/1948 | Powell | 81/63.2 |
| 2,446,776 | A * | 8/1948 | Matson | 81/63 |
| 2,521,419 | A * | 9/1950 | Sellers | 81/63.1 |
| 2,636,411 | A * | 4/1953 | Wood | 81/58.2 |
| 2,757,564 | A * | 8/1956 | Reaves | 81/58.2 |
| 2,982,162 | A * | 5/1961 | Golden | 81/176.3 |
| 4,095,494 | A * | 6/1978 | Castoe | 81/63.2 |
| 4,258,595 | A * | 3/1981 | Ramsey | 81/61 |
| 4,441,387 | A * | 4/1984 | Hendricks | 81/61 |
| 4,562,757 | A * | 1/1986 | Furey | 81/63 |
| 5,113,726 | A * | 5/1992 | Ethridge | 81/60 |
| 5,277,087 | A * | 1/1994 | Wilson et al. | 81/57.29 |
| 5,377,566 | A * | 1/1995 | Mandigo | 81/58.2 |
| 5,467,672 | A * | 11/1995 | Ashby | 81/58.2 |
| 5,501,124 | A | 3/1996 | Ashby | |
| 5,960,679 | A | 10/1999 | Schulthels | |
| 2004/0194589 | A1 | 10/2004 | Stanton | |
| 2005/0044999 | A1 | 3/2005 | Slepekis | |
| 2006/0137492 | A1 | 6/2006 | Melos | |
| 2006/0230882 | A1 | 10/2006 | DeCaprio | |
| 2008/0022812 | A1 * | 1/2008 | Decaprio | 81/60 |

* cited by examiner

*Primary Examiner*—D. S Meislin
(74) *Attorney, Agent, or Firm*—Abelman, Frayne & Schwab

(57) ABSTRACT

A ratchet wrench devised for torquing axially placed hexagonal nut fasteners on hydraulic or similar lines. The wrench is formed of two main components: The first component consists mainly of a straight elongated handle with a semi-circular collar head attached thereto opening to one side. The collar houses three identical metal inserts which when assembled therein form half a peripherally ratcheting wheel with half an axial inner hexagonally shaped socket of predetermined dimensions. The second main component comprises a second mirror-image semi-circular collar housing identical metal inserts, with a tangentially protruding pin member which slides into a slot disposed in the first component. The two components assembled together form a ratcheting wrench with a wheel having an axial hexagonal slot which circumscribes the fastener to be torqued. A spring-biased pawl disposed in the main component engages the ratchet wheel. Spring-biased latches and other mechanisms disposed within the wrench head provide smooth and fast engagement and disengagement of the two head components.

8 Claims, 13 Drawing Sheets

Section A-A

OPEN END RATCHET WRENCH

I. BACKGROUND/FIELD OF THE INVENTION

The present invention is used by plumbers and mechanics continuously engaged in assembling and removing hydraulic lines which require the handling of axially placed fasteners which can only be torqued with open-ended wrenches. Such tasks involve the frequent placement and removal of the wrench from the nut for the completion of a single operation. Such tasks, which are time wasting and exasperating, can be greatly facilitated if an efficient and practicable ratcheting wrench can be devised to deal with them.

The present invention is designed to provide such a ratcheting wrench with a practicably sized head which makes it usable under most confined space conditions; which can be simply and smoothly opened and closed to fit perfectly around a nut fastener perpendicular to its axis, and functions as a standard ratching wrench without subjecting the fastener to damaging wear that may be caused by repeatedly clamping mechanism. (U.S. Pat. No. 5,960,679; U.S. Patent Application Publication Nos. US2004/0194589 and U.S. 2005/0044999).

II. PRIOR ART

U.S. Patent Application Publication No. 2006/0137492 and U.S. Pat. No. 5,501,124 present solutions whereby the hexagonal notch for engaging a bolt is open at one side to allow for the positioning of the notch around the nut. For the system to operate property, the ratcheting head required would be of an exaggerated size that will be awkward to handle in confined spaces. Further, upon removal of the wrench from the tightened nut, the wrench has to be rotated by up to 180 degrees in the neutral mode should the slot in the rotating jaw be aligned opposite to the opening in the head member. In confined spaces, this can be highly problematic, and therefore place limits on the usefulness of the wrench.

U.S. Patent Application Publication No. 2006/0230882 which employs C-shaped collars hingedly connected to a head member would be more practicable in relation to the wrench's head size. The mechanism through which the two C-shaped collars containing the ratcheting inserts swing into position circumscribing the fastener from hinges attached to the C-shaped open head will fail to provide a perfect ratcheting wheel or a perfectly closed hexagonal socket, as this will be hindered by the thickness of the head member or the C-shaped collars as these swing around their hinges. The disengagement of the wrench from the fastener will be problematic in confined spaces as the ratcheting wheel may have to be turned by up to 90 degrees to align the two parts of the ratcheting inserts to the open position for the swinging collars to open up.

III. OBJECTS AND SUMMARY OF THE NEW INVENTION

The invention illustrated herein comprises a ratcheting wrench of a practicable size whereby the head member and the ratcheting wheel with its hexagonal socket can optionally be opened (split up) and closed to perfectly circumscribe a hexagonal nut fastener on a hydraulic (or other similar) line, and henceforth be used as a normal ratcheting wrench.

According to one embodiment of the invention, there is provided a semicircular metal collar head member opening to one side, attached radially to an elongated handle the axis of which is co-linear with its diametrical chord. Below the collar element and at right angles to the handle's axis is a rectangular slot with a circular middle part which runs across the width of the head member from one side up to 2 mm short of the opposite side. Three identical metal inserts which are 60 degree segments of a circular metal disc, ratcheted on the outside perimeter and straight on the inside fit into the metal collar forming one half of a peripherally ratcheted wheel with half a concentric hexagonal socket. The designed rotational movement of the inserts within the head collar and the transfer of forces thereto from the ratchet wheel are provided by a thickening of the inserts on both sides between the inner edge of the circular metal collar and the hexagonal socket, thus forming a bearing rotational shoulder with the adjacent collar. A rectangular groove on one face of the metal inserts coaxial with the perimeter, with three control pin rivets dipped therein from the head member's circular collar stop any inward radial movement of the assembled inserts. Relative movement between adjoining faces of the insert elements is restricted to tangential movement only by vertical pins and corresponding perfectly aligned facing bores on any two adjoining sides of the insert elements. Completing the head member is a second mirror image semicircular metal collar component coplanar with the first one with an elongated tangential metal pin of a cross section which slides into and fits perfectly in the slot in the first collar head component to form a complete circle from the two identical and opposing collars. Disposed within the second semi-circular collar are three additional metal disc inserts identical to the ones in the first member and similarly installed. The circular part of the tangential pin is tubular. Disposed within the tubular pin is a compression spring cartridge biased to push the two semi-circular frame members apart when the pin is inserted into the slot of the first head component. A notch in the rectangular side of the pin and a corresponding spring-biased unidirectional pawl in the first component are provided to prevent the separation of the two components while they are in the open mode.

The wrench is engaged to the hexagonal tie member to be tightened with the two components in the "open" mode. The second component is then pushed towards the first component along the axis of the notch in the first component until the two semi-circular frame components touch to form a complete circle. In this "closed" mode the six metal insert components circumscribe the hexagonal tie in a perfectly fitting hexagonal socket. A notch deployed in the rectangular side of the tangential pin in the second component and a corresponding spring-biased locking tab in the first component maintain the two collar frames in the closed position during the tightening operation.

Upon turning the ratchet handle around the nut's axis, a ratchet pawl disposed inside the first component adjacent to the ratchet wheel's perimeter engages the ratchet wheel thus providing the required torquing mechanism. The ratchet pawl can be disengaged (placed into a neutral mode) through a switch handle disposed on the outer face of the first component, and connected to the pawl's pivot pin inside the head member.

Upon completion of the operation, the ratchet pawl is disengaged to allow neutral bidirectional rotational movement of the wrench around the nut's axis. A spring controlled button disposed on the first component is pushed by the operator thus applying constant pressure on a pin which is connected to the spring biased mechanism which locks the two components together. Movement of the subject pin and the connected locking mechanism remain restricted by the rotating ratchet wheel components until the pin is perfectly aligned with any of matching holes disposed axially in each of the insert components. This is designed to occur only when radial edges of the insert components are in line with the common radial axis of the two semi-circular frames, and the pins and facing bores on the adjoining faces of the insert elements are at right angles thereto. When the pin sinks into the facing hole, the locking tab is disengaged, thus allowing the compressed spring cartridge inside the tubular pin to push the two semi-circular collar members apart releasing the tightened nut. The sunken pin in the insert elements remains in position preventing their rotational movement in the first component while the wrench head is in the open mode. A spring biased latch with a wedged head and an inward projecting tooth sized to fit radially into the wheel's peripheral ratchet teeth is disposed in the second head component tangentially with the ratcheting wheel. The latch is disengaged when the two head components are in the closed mode through pressure against the wedged head provided by a pin disposed in the first component. Upon separation of the two head parts, the latch's head is released sinking its projecting tooth into the wheel's peripheral ratchet teeth thus preventing any rotational movement of the inserts in the second component while the ratchet head is in the open mode. The matching pins and corresponding holes in the adjoining sides of the metal inserts prevent their separation one from the adjacent other during this stage.

When the two adjacent semicircular collars are pushed together into the closed mode, the wedged head of the latch on the second component is pushed out by the pin in the first component thus releasing the three (connected) insert elements in the second component for rotational movement. As the semicircular collars close together, the notch in the elongated pin in the second component is aligned with the spring biased locking tab in the first component, which moves up into the notch thus locking the two components together. The pin attached to the locking tab moves simultaneously out of the bore in the insert elements in the first component thus releasing them for rotational movement.

When the two adjacent semicircular collars are pushed together into the closed mode, the wedged head of the latch on the second component is pushed out by the pin in the first component thus releasing the three (connected) insert elements in the second component for rotational movement. As the semicircular collars close together, the notch in the elongated pin in the second component is aligned with the spring biased locking tab in the first component, which moves up into the notch thus locking the two components together. The pin attached to the locking tab moves simultaneously out of the bore in the insert elements in the first component thus releasing them for rotational movement.

According to a second embodiment of the invention, the elongated pin protruding tangentially from the second semicircular collar component has a solid cross-section. The lower rectangular part of the pin has a plurality of notches on one side only along its entire length. A wheel with compatible notches (pinion) with a biased torsion spring engages the pin (rack) from below. The pinion winds up when the pin member is pushed into the slot, and tends to push it in an outward direction when the locking mechanism of the two semi-circular collars is released, thus separating the two semi-circular collar heads and releasing the tie nut.

According to a third embodiment of the invention designed for economic mass production; both two components of the wrench are made up of three flat metal plates riveted together (two casing parts and one core part). The three parts can be stamped out by dies and require no machining, thus reducing the production cost thereof. A semicircular tongue is stamped out into the inner face of one of the casing parts of the wrench to accommodate the groove in the rotating ratcheting inserts thus preventing their inward radial movement when the two head parts are in the open mode. The elongated tangentially protruding pin which is part of the second head frame component is rectangular with a plurality of notches and with a disengaging mechanism as described in the second embodiment of the invention. Two rectangular grooves disposed on the sides of the elongated pin with corresponding compatible tongues stamped out in the opposing inner faces of the casing plates control lateral movement of the pin as it slides into and out of the cavity in the second component. Two spring biased latches with wedged heads and teeth sized to fit into the peripheral ratchet teeth are disposed tangentially on the perimeters of the two head components. In the locked head condition, the latches are kept unengaged through outward pressure exerted against their heads by suitably shaped indentations deployed in the opposing semicircular frames, thus allowing free rotational movement of the ratchet wheel.

To disengage the wrench from the tightened nut, the locking mechanism of the two ratchet head components is released, and the ratchet pawl is disengaged to allow neutral bidirectional rotation of the of the wrench around the nut. The wrench is turned (by no more than 30 degrees) in either direction to align any adjoining line of adjacent inserts with the axis of the wrench, whereat the matching pins and corresponding holes in the adjoining sides of the insert elements are at right angles to the axis, thus allowing the separation of the semicircular head components each with a set of three inserts. When the two head components separate, the spring biased tangential latches are released to sink their teeth into the peripheral ratcheted teeth of the insert components thus preventing their rotational movement while the wrench head is in the open mode.

BRIEF DESCRIPTION OF THE DRAWINGS

The invention described herein is best described in conjunction with the following attached drawings and illustrations.

V. DETAILED DESCRIPTION OF THE PREFERRED EMBODIMENTS

For convenience and clarity in describing these embodiments, similar elements or components appearing in different figures will have the same reference numbers.

The invention illustrated herein discloses a ratcheting wrench with a practicably sized head that is suitable for use in most confined spaces; can be simply and smoothly opened and closed to fit closely around a nut fastener perpendicular to its axis, and functions as a standard ratcheting wrench without subjecting the fastener to damaging wear that may be caused by repeatedly clamping mechanisms.

In the following preferred embodiments of the invention as shown in FIGS. 1-12, identical part components with identical functions in the different embodiments of the invention have been marked with the same reference numbers.

Figure 1:
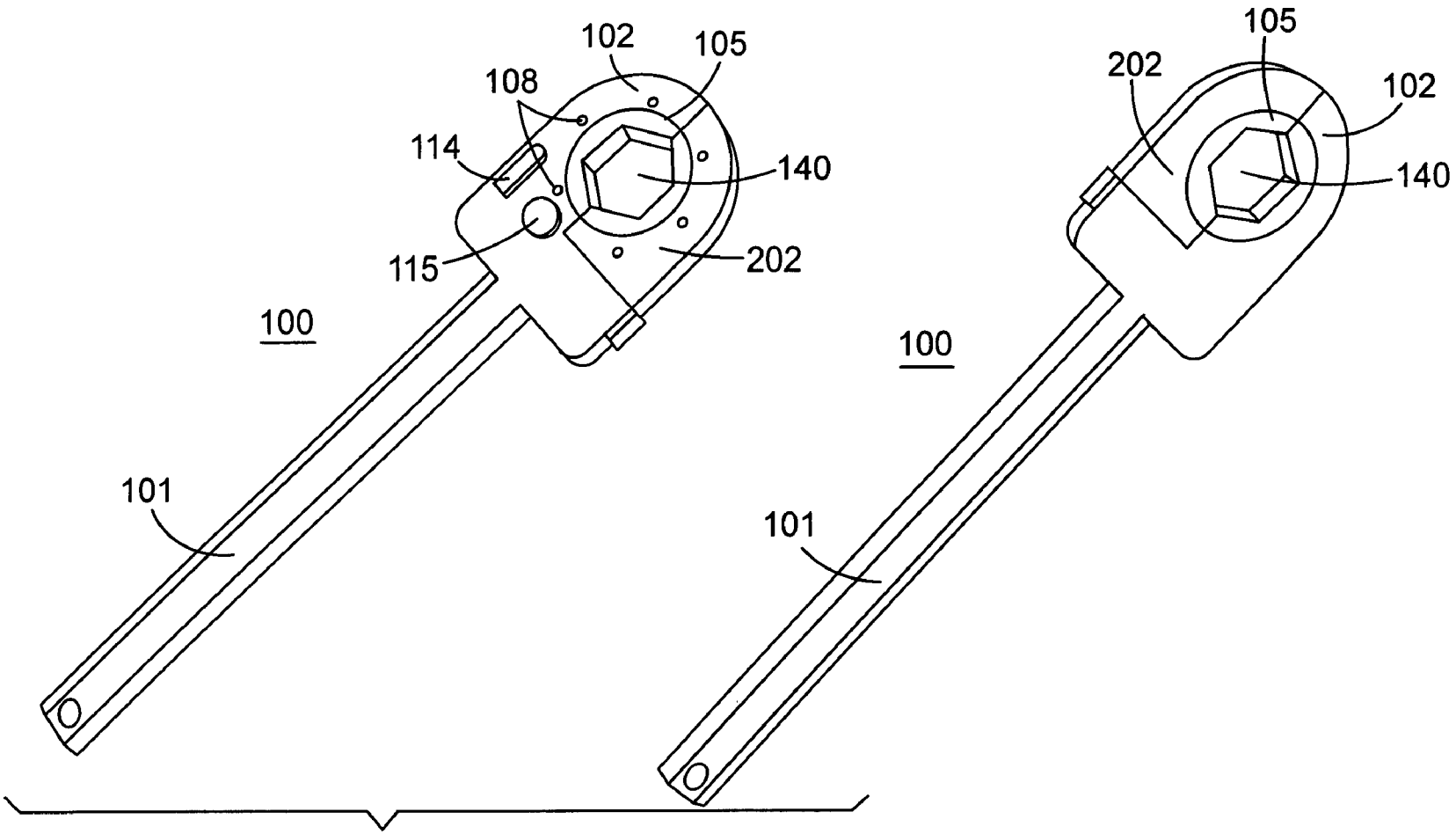
FIG. 1 is a schematic perspective view from both sides of the open end ratchet wrench in the closed mode. Shown are the elongated wrench handle; the assembled ratchet head with its segmented ratchet wheel and axial hexagonal slot; the switch handle for disengaging the pawl and setting it into the neutral mode; the release button for separating the two wrench's head segments, and the six rivets which stop the ratchet wheel inserts from inward axial movement when the two head components are in the open mode.
Figure 1A:
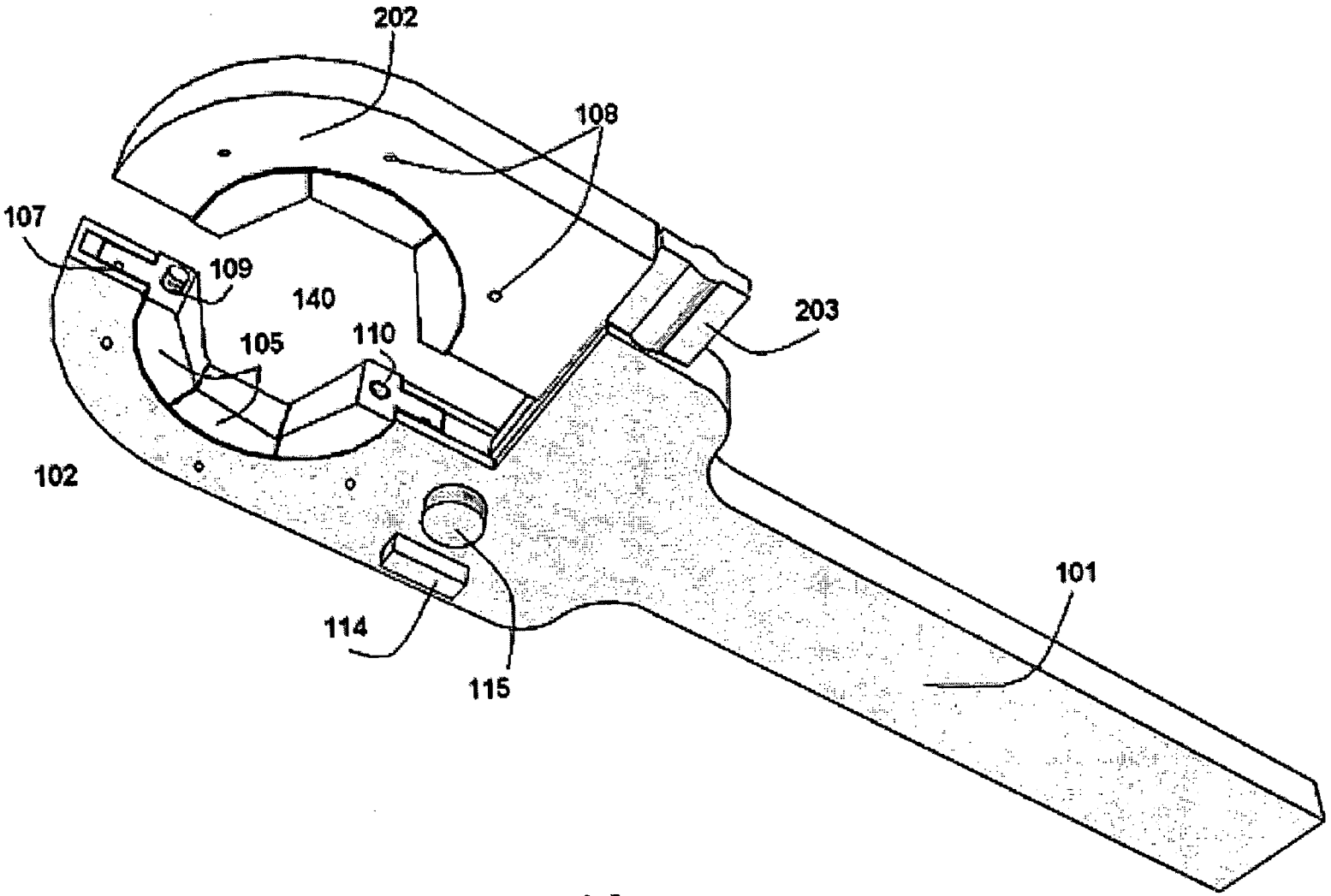
FIG. 1A is a face and right side schematic perspective view of the wrench of FIG. 1, constructed according to the present invention.
Figure 2:
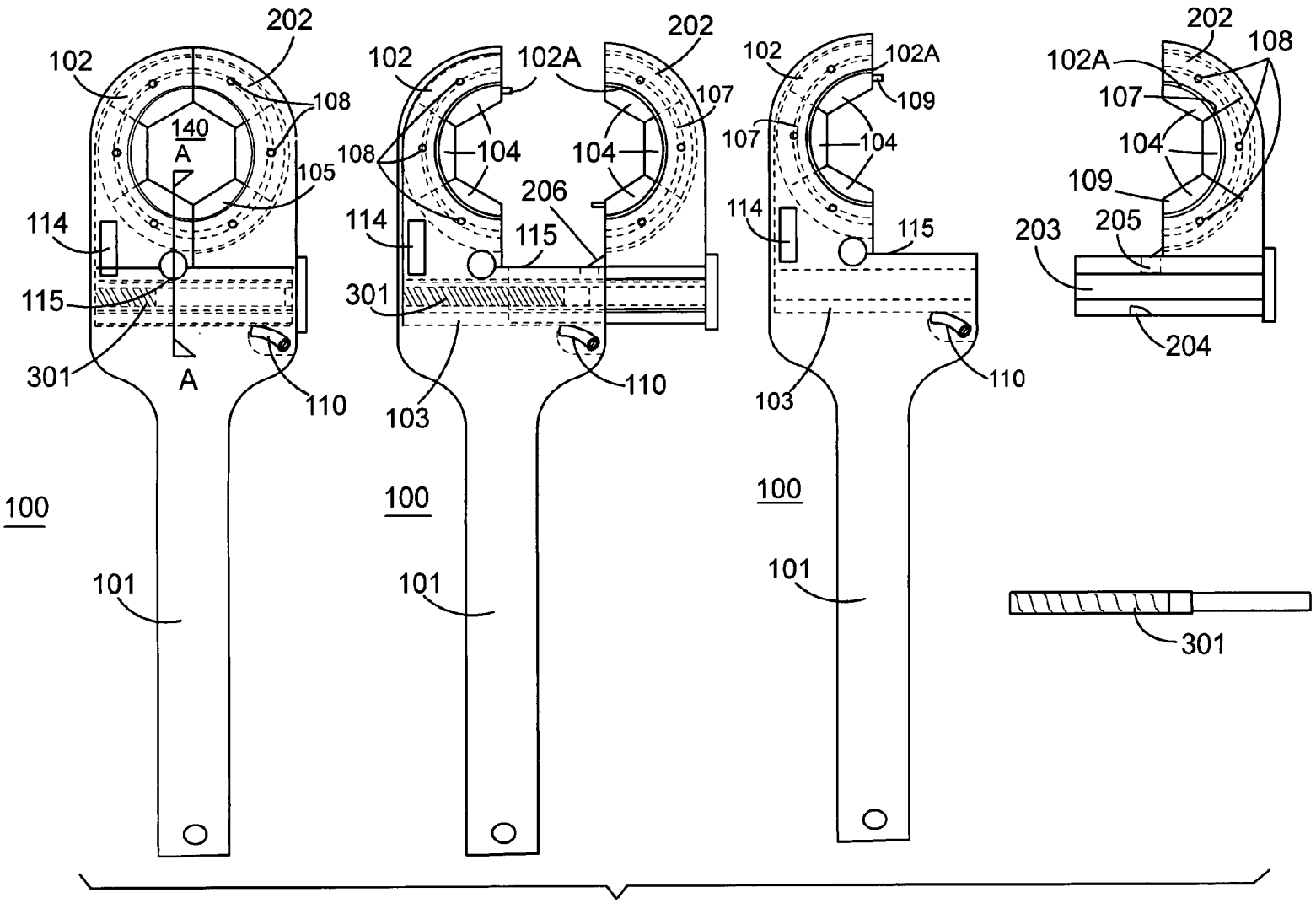
FIG. 2 is a face view of the ratchet wrench with the two head components in the closed and open modes, showing the main internal parts of the head component, and the biased spring mechanism which separates the two head components.

FIGS. 1-2 are schematic diagrammatical illustrations of the wrench 100 with an elongated handle 101, and a semicircular channeled collar head member 102 opening to one side. Below collar member 102, in coplanarity therewith, and at right angles to the handle's axis is a rectangular slot with a circular middle part 103. The slot runs across head member 102 up to 2 mm short of the opposite side. Three identical metal inserts 104 which are 60 degree segments of a circular metal disc, ratcheted on the outside arcuate perimeter and straight on the inside fit into semicircular collar 102 forming one half of a peripherally ratcheted wheel 105 with half a concentric hexagonal socket 140. The designed rotational movement of inserts 104 within head collar 102 and the transfer of forces thereto from the ratchet wheel is provided by a thickening (flanging) of inserts 104 on both sides between the circular metal collar inner edge 102A and the hexagonal socket 140, thus forming a bearing rotational shoulder with adjacent collar 102. A rectangular arcuate groove 107 on one face of metal inserts 104 concentric with collar 102, with three control pin rivets 108 dipped therein from the head member's circular collar 102 stop any inward radial movement of the assembled inserts. Relative movement between adjoining faces of the insert elements is restricted to tangential movement only by vertical pins 109 and corresponding aligned facing bores 110 on any two adjoining sides of the insert elements.

Completing the head member is a second mirror image semicircular metal collar component 202 coplanar with 102 with an elongated tangential metal pin 203 of a cross section which slides into and fits perfectly in slot 103 to form a complete circular collar from the two opposing components. Disposed within the second semi-circular collar 202 are three additional metal disc inserts 104 identical to the ones in 102 and similarly installed. The circular part of metal pin 203 is tubular. Disposed therein is a compression spring cartridge 301 biased to push pin 203 out of slot 103. A notch 204 in the lower rectangular side of pin 203 and a spring biased unidirectional pawl 110 in the first component are provided to prevent the separation of components 102 and 202 when the ratchet head is in the open mode.

The wrench is engaged to the hexagonal tie member to be tightened with the wrench head in the "open" mode (members 102 and 202 separated). Component 202 is pushed towards component 102 along the axis of notch 103 in the first component until the two semi-circular frame components touch to form a complete circle. In this "closed" mode the six metal insert components 104 form a ratcheting wheel 105 circumscribing the hexagonal tie in a perfectly fitting hexagonal socket 140. A rectangular notch 205 in the upper rectangular side of tubular pin 203 and a corresponding spring biased locking tab 111 in the first component maintain collar frames 102 and 202 in the closed mode during the tightening operation.

Upon turning ratchet handle 101 around the nut's axis, a spring biased ratchet pawl 112 pivoted to pin 113 and disposed inside the first component adjacent to the ratchet wheel's perimeter engages the ratchet wheel thus providing the required torquing mechanism.

The ratchet pawl can be disengaged (placed into a neutral mode) through a switch handle 114 disposed on the outer face of the first component and attached to pin 113. Pin 113 is attached inside the first component to cam 179, which upon turning switch handle 114 in a clockwise direction, pushes pawl 112 out of the ratchet wheel's teeth range, and locks it into that position through detent head 180 and arch spring 181 until switch handle 114 is turned back anticlockwise to its original engaged position.

Upon completion of the tightening operation, ratchet pawl 112 is disengaged to allow neutral bidirectional rotational movement of the wrench around the nut. A button 115 disposed on the first component and controlled by a compression spring 118 is pushed by the operator thus applying constant pressure on a pin 116. Pin 116 is connected to locking tab 111 which is constantly biased to fit into notch 205 by compression spring 119. The rigidity of spring 118 is greater than that of spring 119, such that the resultant force from button 115, unrestricted, would tend to push locking tab 111 out of notch 205. Movement of pin 116 and the connected locking mechanism remain restricted by rotating ratchet wheel 105 until the pin is perfectly aligned with any of matching bores 106 disposed axially in each of the insert components. This is designed to occur only when radial edges of the insert components 104 are in line with the common radial axis of the two semi-circular frames 102 and 202, and the pins 109 and facing bores 110 on the adjoining faces of insert elements 104 are at right angles thereto. When pin 116 sinks into facing bore 106, locking tab 111 is pushed out of slot 205, thus allowing compressed spring cartridge 301 inside tubular pin 203 to push semi-circular collar members 102 and 202 apart releasing the tightened nut. Pin 116 further prevents any rotational movement of inserts 104 inside semicircular frame 102 while the wrench head is in the open mode. A spring biased latch 206 with a wedged head and an inward projecting tooth sized to bite radially into the peripheral ratchet teeth is disposed in the second head component tangentially with the ratcheting wheel. The latch is disengaged when the two head components 102 and 202 are in the closed mode through pressure against the wedged head provided by pin 118 disposed in the first component. Upon the separation of frames 202 and 102, the latch's wedged head is released thus allowing the projecting tooth to bite into the peripheral ratchet teeth and prevent any rotational movement of inserts 104 in component 202 while in the ratchet head is in the open mode. Pins 109 and corresponding bores 110 in adjoining sides of metal inserts 104 prevent their separation one from the adjacent other during this stage.

When the two adjacent semicircular collars 102 and 202 are pushed together into the closed mode, the wedged head of latch 206 is pushed out by pin 118 thus releasing the three (connected) insert elements 104 in frame 202 for rotational movement. As semicircular collars 102 and 202 close together, notch 205 in the elongated joining pin 203 is aligned with tab 111, which is biased to move into notch 205 by compression spring 119, thus locking the two components together. Pin 116 is simultaneously pushed out of bore 106 thus releasing insert elements 104 therein for rotational movement in collar head 102.

Figure 3:
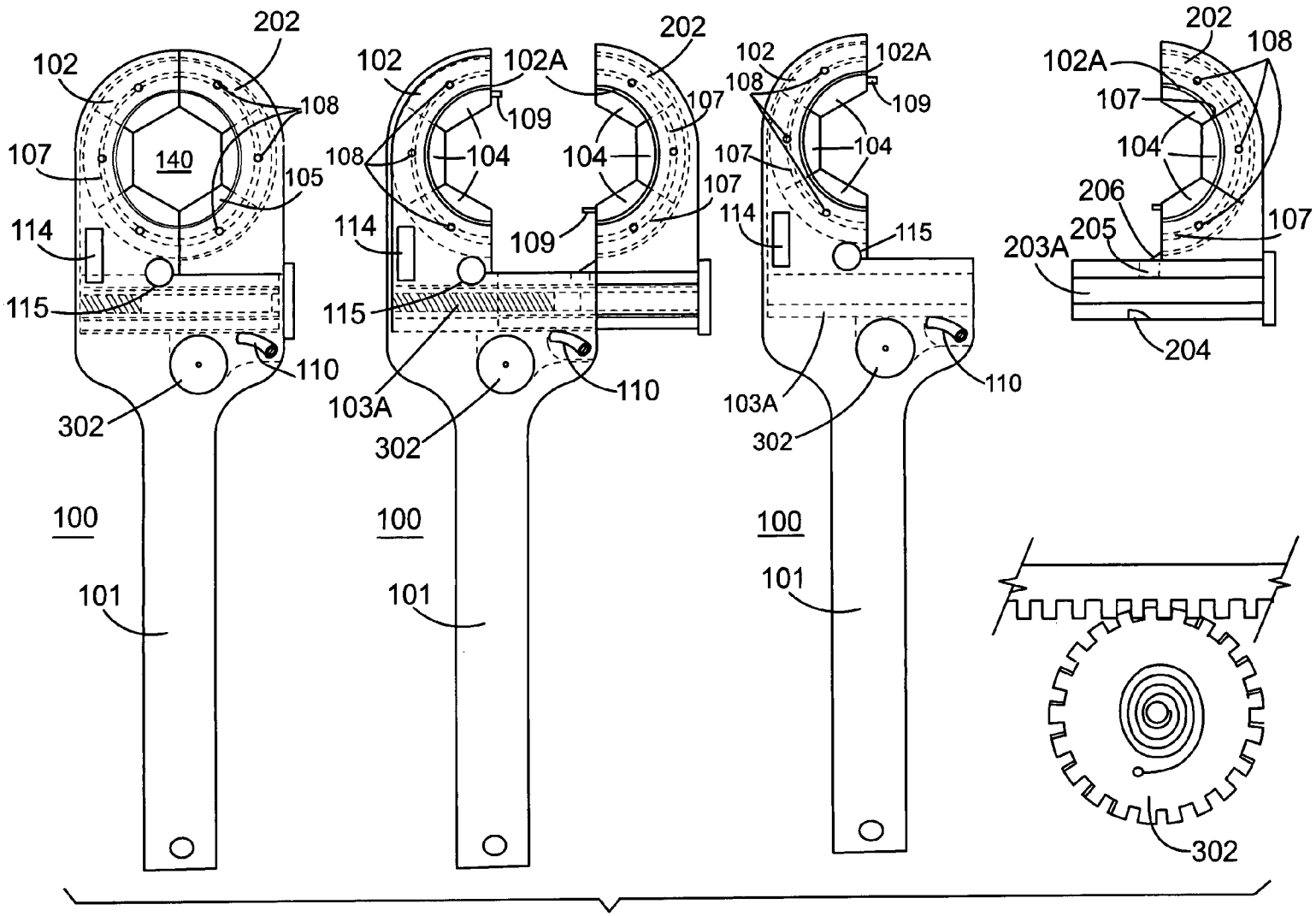
FIG. 3 is a face view of the second embodiment of the open end ratchet wrench with a biased torque spring acting on a rack and pinion mechanism for separating the two head components.
Figure 4:
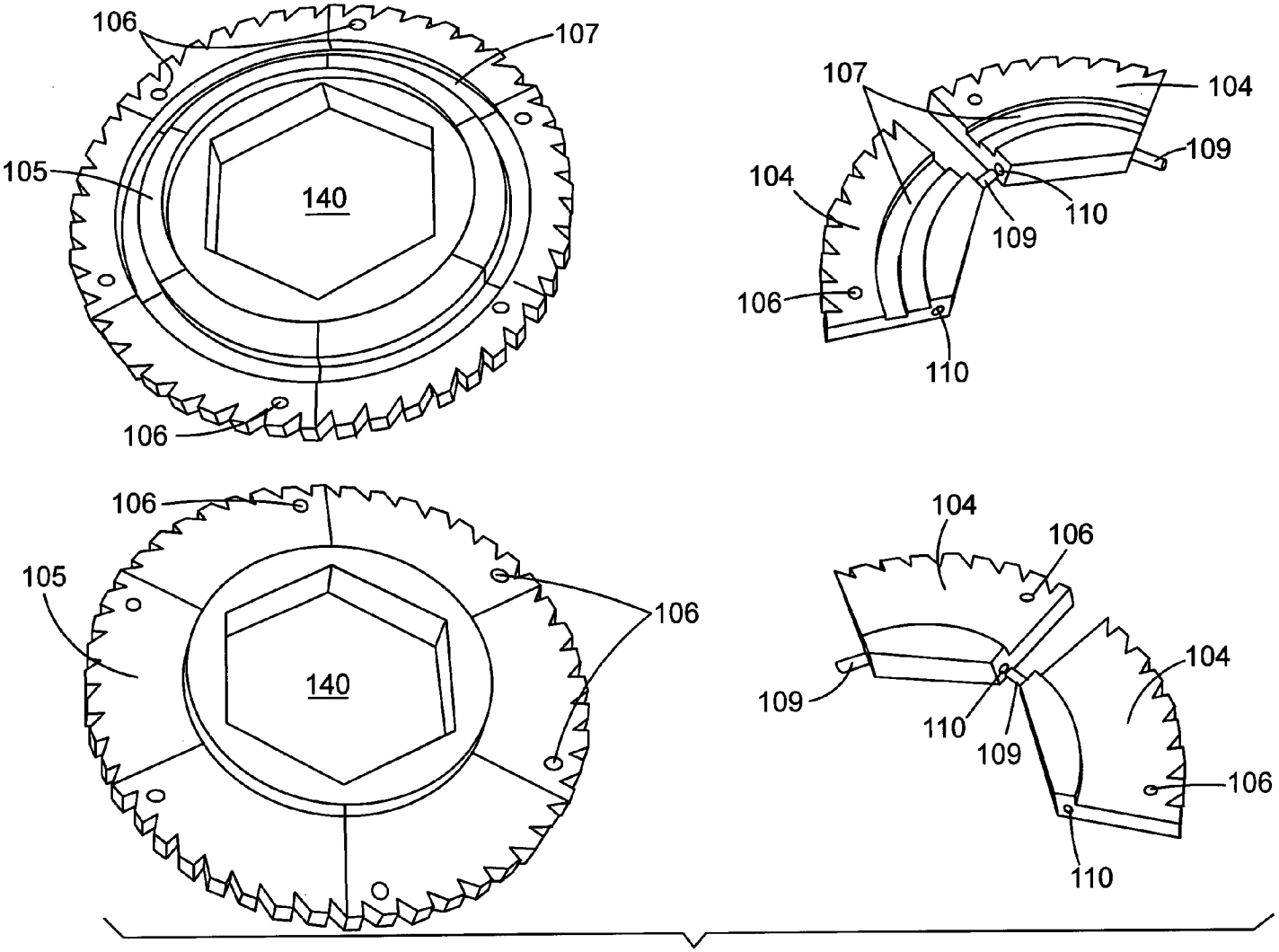
FIG. 4 is a face view of the segmented ratchet wheel from both sides.
Figure 5:
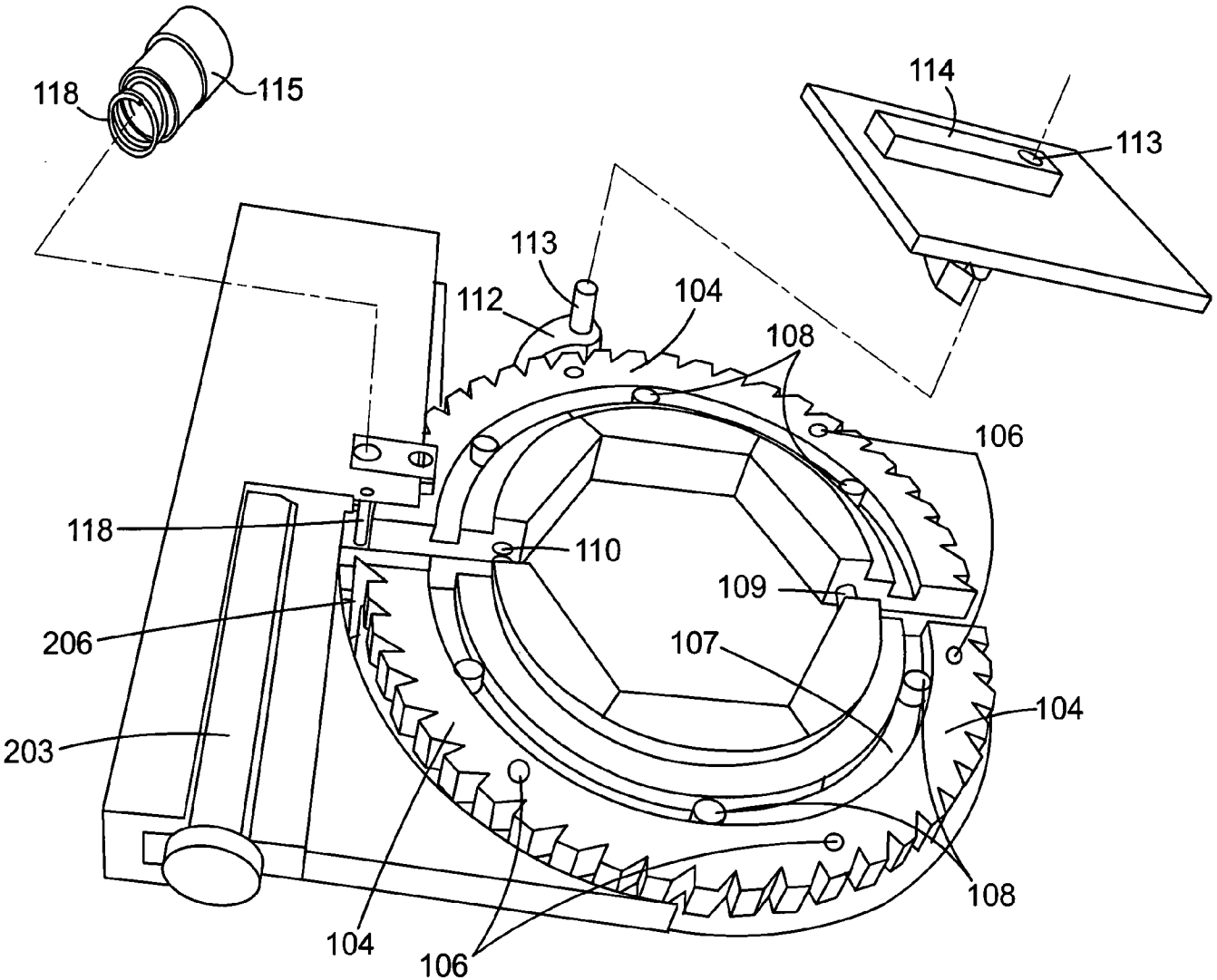
FIG. 5 is a diagrammatic illustration of the wrench's head member showing its interior components.
Figure 6:
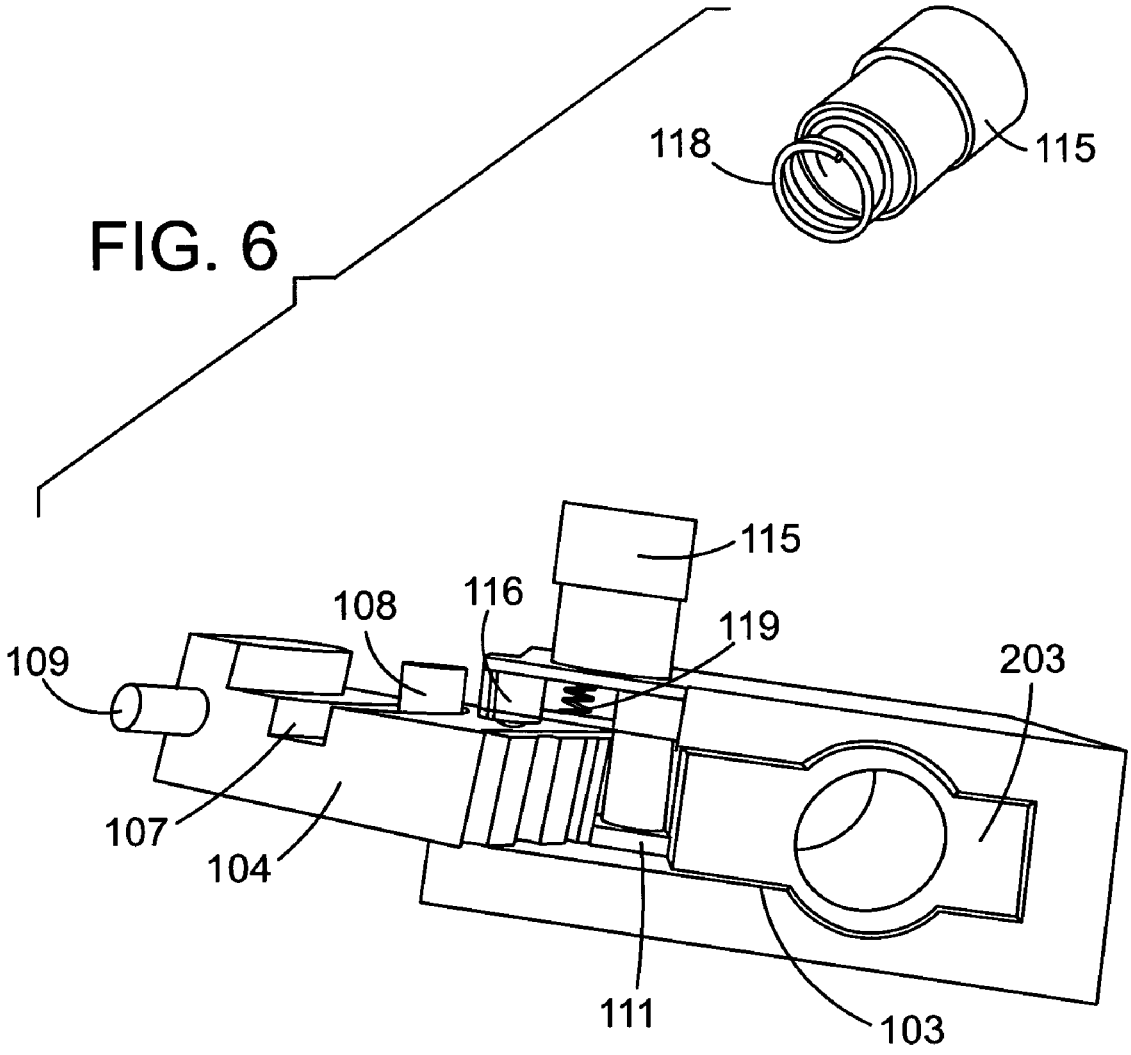
FIG. 6 is a diagrammatic illustration of the locking mechanism of the two head components.
Figure 7:
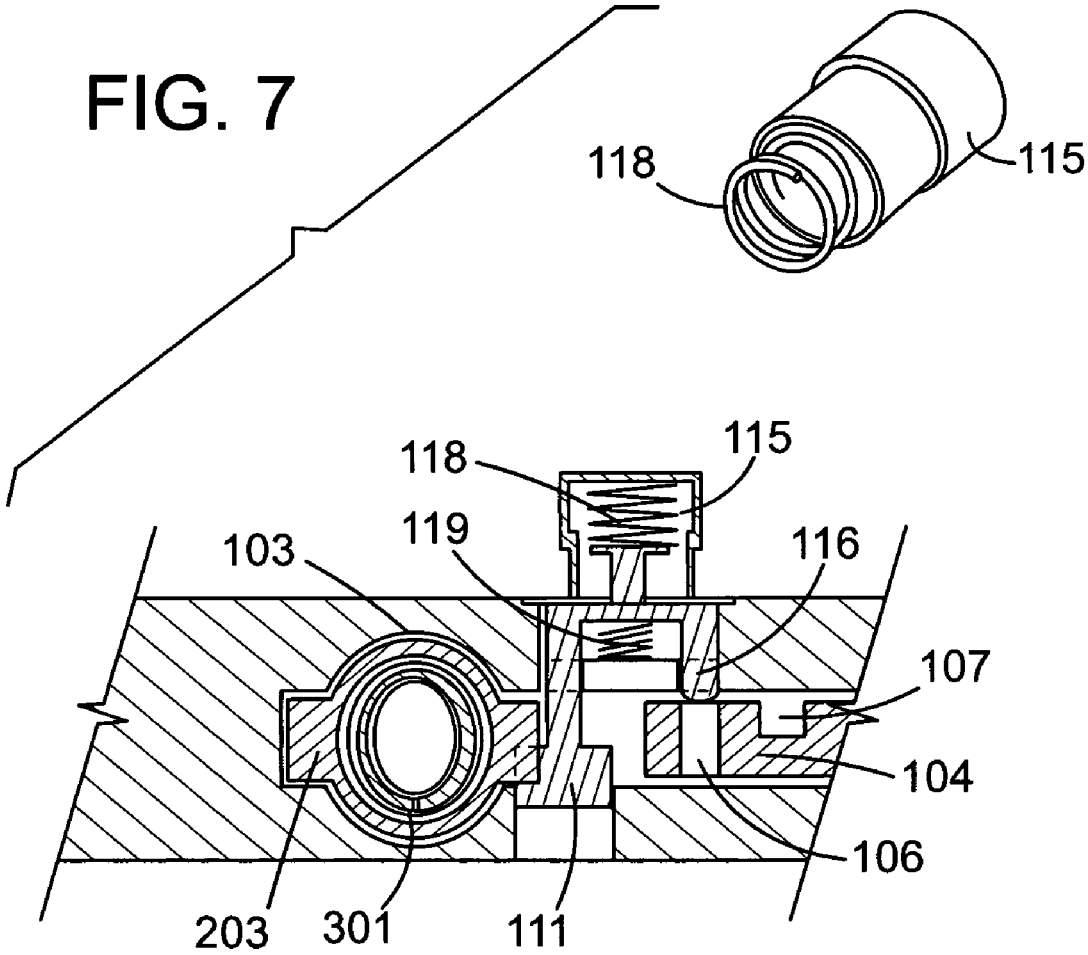
FIG. 7 is a cross-sectional view of the locking mechanism of the two head components (cross-section A-A from FIG. 2)
Figure 8:
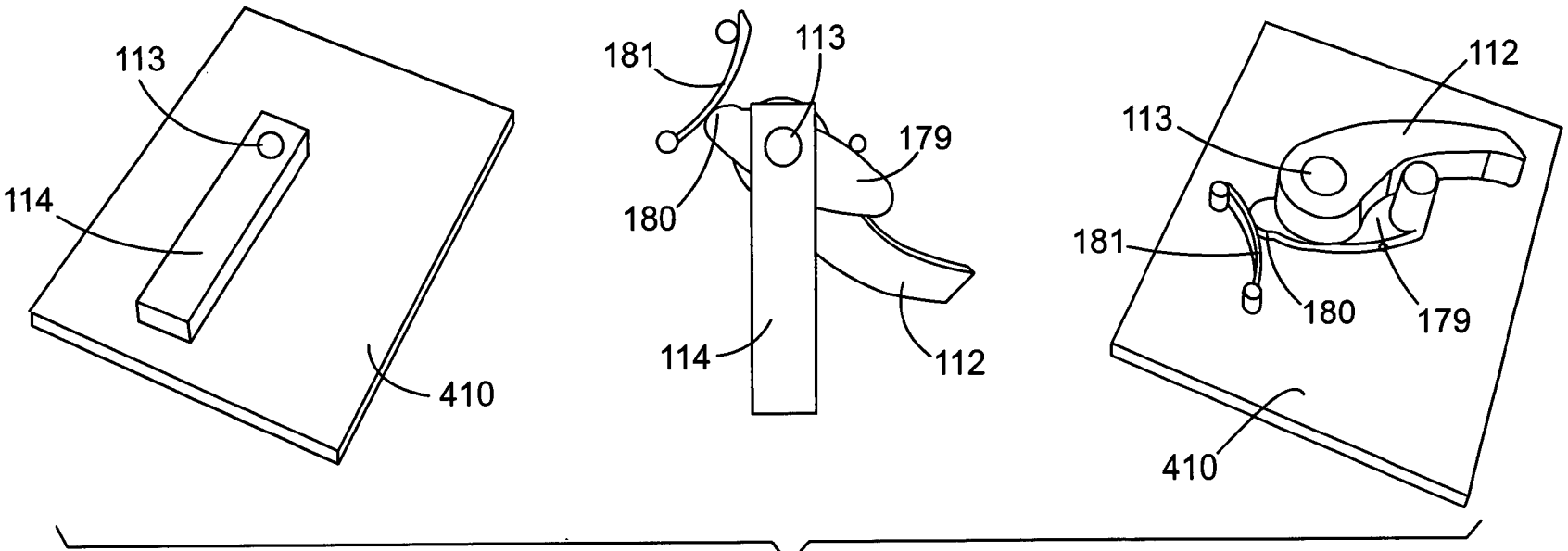
FIG. 8 is a diagrammatic illustration of the ratchet pawl and its switch handle on the face of the wrench's head.
Figure 9:
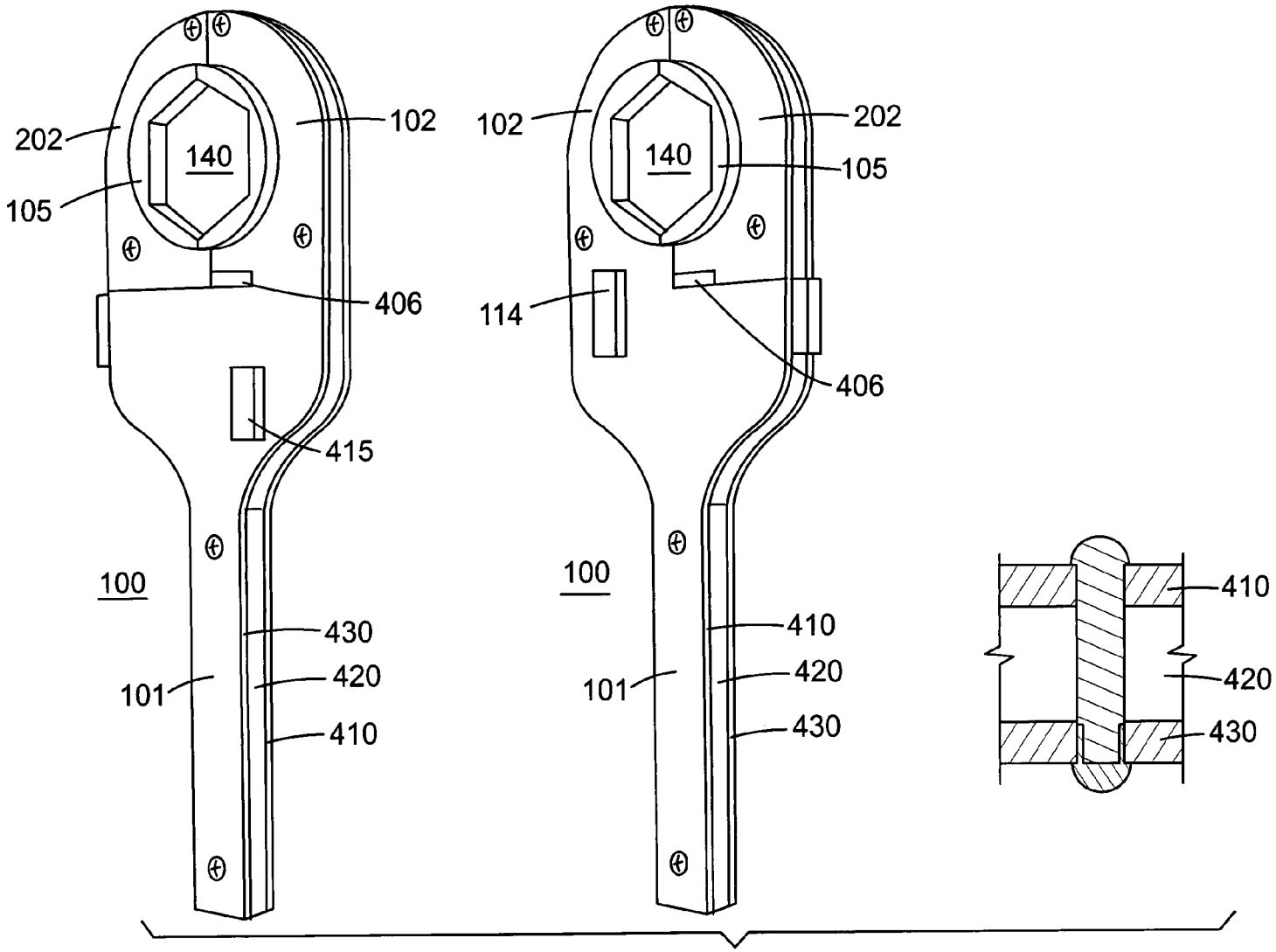
FIG. 9 is a diagrammatic perspective view from both sides of the third embodiment of the open end ratchet wrench in the closed mode. Shown are the elongated wrench handle; the assembled ratchet head with its segmented ratchet wheel and axial hexagonal slot; the switch handle for disengaging the pawl and setting it into the neutral mode; the switch handle for unlocking the two head segments, the rivets which hold together the three flat metal plate wrench components, and the spring biased latches which stop the rotational movement of the ratchet wheel segments when the wrench head is in the open mode.
Figure 10:
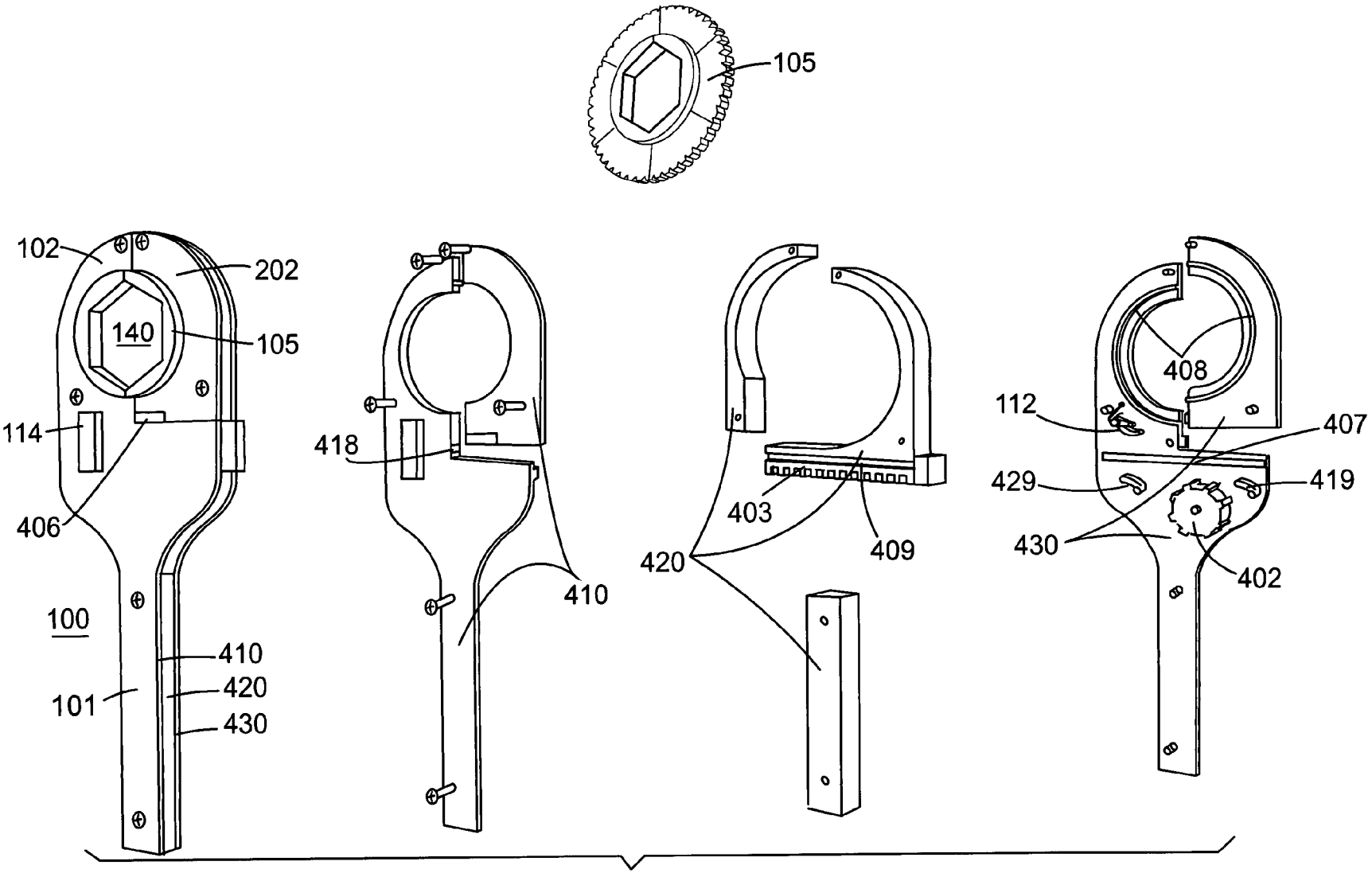
FIGS. 10 and 11 are diagrammatic views of the third embodiment of the ratchet wrench showing the interior components.
Figure 11:
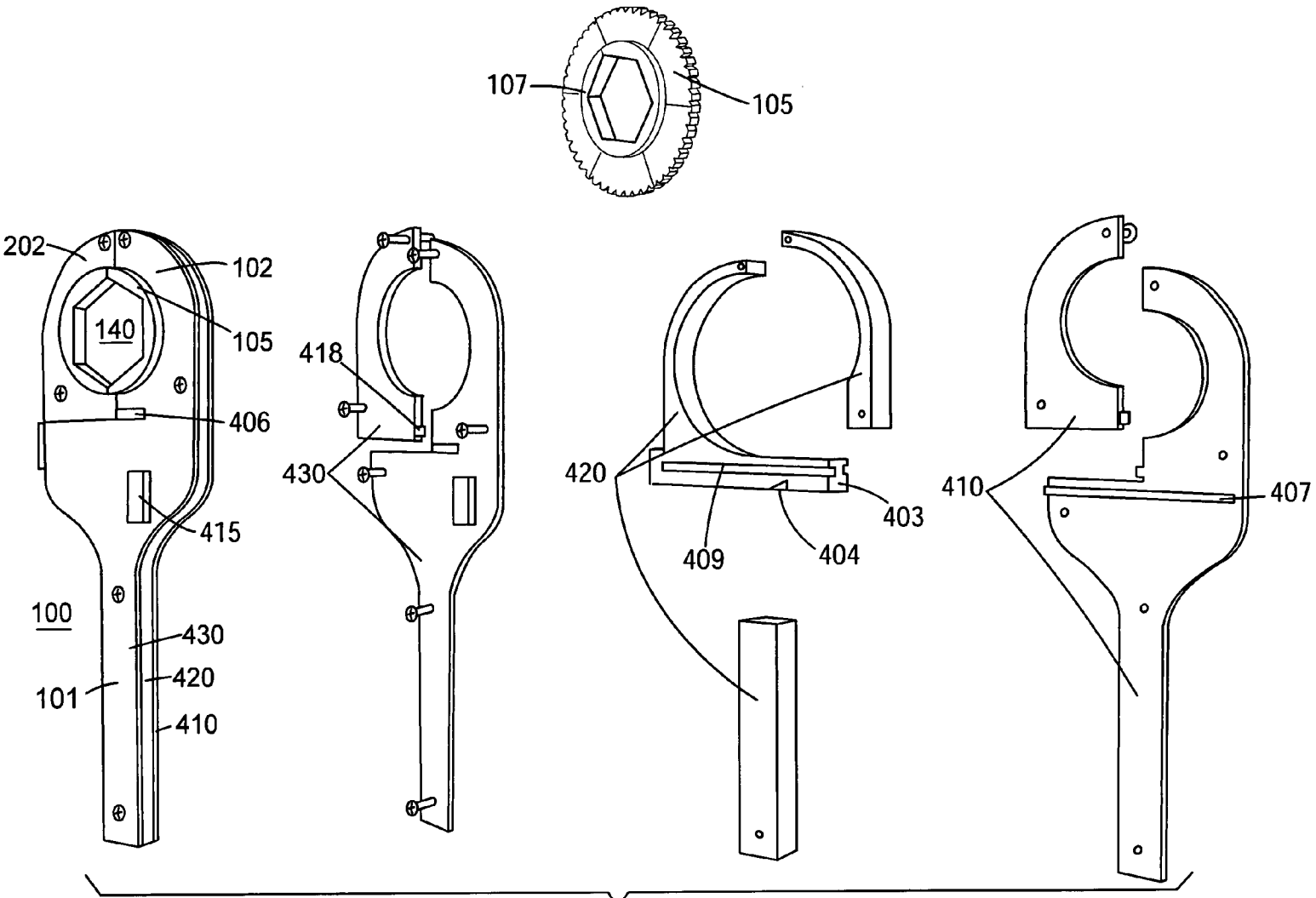
Figure 12:
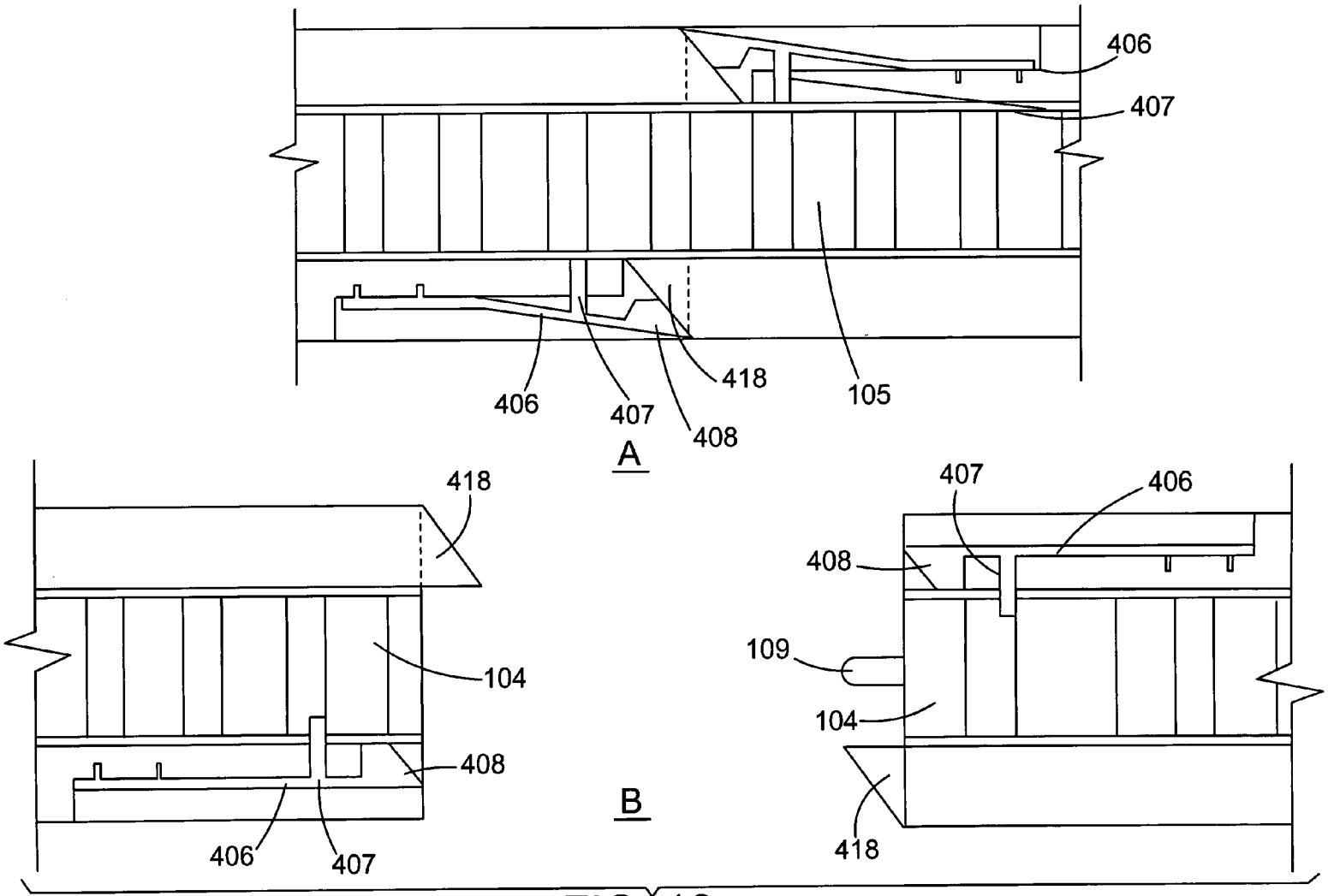
FIG. 12 is a cross-sectional view of the spring-biased side latches in the third embodiment of the ratchet wrench which stop the ratchet wheel segments from rotational movement while the wrench's head is in the open mode.

According to a second embodiment of the invention as illustrated in FIG. 3, the elongated pin 203A protruding tangentially from the second semi-circular collar 202 has a solid cross-section (including the circular middle part). One side of the lower rectangular part of pin 203A has a plurality of notches along its entire length. Wheel (pinion) 302 with compatible notches and a biased torsion spring 303 engages the pin rack from below. Pinion 302 winds up its torsion spring when pin member 203A is pushed into slot 103A, and when the locking mechanism of the two semi-circular collars 102 and 202 is released, tends to push pin 203A in an outward direction, thus separating the two semi-circular collar head components and releasing the tie nut.

According to a third embodiment of the invention designed for economic mass production as illustrated in FIGS. 9-12; both two components of the wrench are made up of three flat metal plates riveted together (two casing parts 410 and 430, and one core part 420). The three parts can be stamped out by dies and require no machining, thus reducing the production cost thereof. A semicircular tongue 408 is stamped out into the inner face of casing part 430 of the wrench head component to accommodate groove 107 in rotating ratcheting inserts 104 thus preventing their inward radial movement when the two head parts are in the open mode. Two rectangular grooves 409 disposed on the sides of the elongated rectangular pin 403 with corresponding compatible tongues 407 stamped out on the opposing inner faces of casing plates 410 and 430 control lateral movement of the pin as it slides into and out of the second component. Pin 403 is provided with a plurality of notches along the lower part of one side. A wheel (pinion) 402 with compatible notches and a biased torsion spring attached thereto engages the (rack) pin from below.

The pinion winds up its torsion spring when pin 403 is pushed into place, and tends to separate the two head parts apart when the locking mechanism is released. A triangular notch 404 in the plain lower side of pin 403 and a spring biased unidirectional pawl 419 in the first component are provided to prevent the separation of the two components while they are in the open mode. In the closed head mode, the same notch 104 is engaged by a second spring biased pawl 429 which can be disengaged through a switch handle 415 disposed on the outer face of the first component. Two spring biased latches 406 with wedged heads 408 and teeth 407 sized to bite into the peripheral ratchet teeth are disposed on the perimeters of the two head components. In the locked head condition, latches 406 are kept unengaged through outward pressure exerted against their heads by suitably shaped indentations 418 deployed in the opposing semi-circular frames, thus allowing free rotational movement of ratchet wheel 105. To remove the wrench head from the tightened nut, pawl 112 is disengaged through switch handle 114 to allow free bidirectional rotation of ratchet wheel 105. Locking pawl 429 is disengaged by turning switch handle 415 clockwise, while the wrench is being rotated around the nut either clockwise or anti-clockwise (as is more convenient) by a maximum of 30 degrees. When any two adjacent radial edges of insert components 104 are in line with the common radial axis of the two semi-circular frames 102 and 202, and the pins 109 and facing bores 110 on the adjoining faces of insert elements 104 are at right angles thereto, spring biased pinion 402 pushes racked pin 403 outwards until pawl 419 engages notch 404 thus preventing any further outward movement. When the two head components separate, spring biased latches 406 are simultaneously released to sink their teeth 407 into the wheel's peripheral ratchet teeth thus preventing any rotational movement of inserts 104 while the ratchet head components are in the open mode.

According to a fourth embodiment of the invention, (not shown in the attached drawings and illustrations), the ratchet teeth are rectangular in shape engaged by a bi-directional pawl which can be set into active rotation clockwise or anti-clockwise, or into the neutral mode, through a switch handle connected thereto from the face of the wrench head.

The above illustrations and descriptions are not to be construed as limiting to the scope, spirit or details of the invention. Variations thereof, omissions therefrom or additions thereto can be made without departing from the spirit and scope of the invention.

While the invention has been described in conjunction with several embodiments, it is to be understood that many alternatives, modifications, and variations will be apparent to those skilled in the art in light of the foregoing description. Accordingly, this invention is intended to embrace all such alternatives, modifications, and variations which fall within the spirit and scope of the appended claims.

The invention claimed is:

1. An open end ratcheting wrench comprising:

(a) a first fixed semi-circular channeled collar head member opening sideways and attached radially to an elongated handle which is coaxial with the collar's diametrical chord, said collar head member having a rectangular slot with a circular middle part traversing the head member at right angles to the handle's axis between said collar and handle from one side toward the opposite side;

(b) a second laterally movable semi-circular channeled collar head member, being a mirror-image to said first fixed semi-circular channeled collar head member, with a hollowed pin of a cross-section and length compatible with said slot of the first part, said pin extending tangentially with its diametrical chord, a circular part of said pin being tubular to accommodate a compression spring cartridge of compatible dimensions, a rectangular part of said pin having a rectangular notch on the upper side of one face thereof corresponding to a locking tab, and a triangular notch on the lower side of the opposite face corresponding to a unidirectional pawl, both being located inside the wrench's head component;

(c) a compression spring cartridge comprised of two hollowed tubes of the same length, each closed at its distal end and adapted to slide axially one inside the other, with an internal compression spring exerting an outward force on the two closed ends of said cartridge, said compression spring cartridge positioned inside said hollowed pin, and when fully compressed, said cartridge does not exceed in length that of the hollowed part of the pin, the open ends of the two hollowed tubes being shaped to prevent their separation when the cartridge is fully extended;

(d) a metal disc comprised of six identical 60 degree segments, ratcheted on the outside perimeter, with an axial hexagonal slot of predetermined dimensions to accurately circumscribe a standard-size nut, adjacent segments of said disc having corresponding compatible pins and bores on each two facing sides normal to their common axis, one fitting into the corresponding other, the segment of the disc extending between the slot and the circular collar of said head being of increased thickness on both faces, thus providing a rotational shoulder between said ratchet wheel and said collar head, a coaxial rectangular groove located within the segment of the disc set inside said collar member on one face, six rivets disposed through the circular collar of a diameter equal to the width of the groove and extending therein to prevent the wheel segments from moving inward radially in the open wrench head mode, a single bore being disposed on the face of each insert segment close to its ratcheted perimeter and radial side corresponding with a locking pin which moves therein when the head member is in the open mode;

(e) a spring-biased pawl pivoted to a pin inside the wrench head allowing unidirectional rotation of the ratchet wheel and shaped to block counter rotation thereof, a cam plate underlying said pawl coaxially, attached to a control handle on the outside face of said wrench head through said pawl's pivot pin to rotate independently from said pawl, said cam having a pin eccentric with said pivot pin on one side adjacent to the inner side of said pawl, and a detent head on the opposite side of said pawl which slides against an arch spring, whereby turning the external control handle clockwise causes the pin on the cam to distant the pawl from the ratchet teeth and moves the detent head to the opposite side of the arch spring where it remains until the control handle is turned back to its original position;

(f) a pressure button comprised of two cylindrical parts of equal lengths which slide axially one inside the other and shaped to remain attached together, the outer cylinder having one side closed and the inner cylinder being open on both sides, a compression spring inside the button of a length when compressed to its limit is shorter than that of the button in the pressed mode, and when released freely is longer than that of the unpressed button, an elongated flat plate with two cylindrical pins normal to its lower surface receives inward pressure from the button's spring relative to the face of said head when the button is pressed by the operator, a second compression spring of lesser rigidity than the button's spring disposed below the plate which tends to push said plate and attached pins outwards, one of the two pins attached to the plate corresponding with any of the bores in the surface of the ratchet wheel, and sinking therein when the ratchet wheel is turned to the open head position, the second pin being attached to a locking tab which engages the rectangular notch in the attaching pin when the two are perfectly aligned together;

(g) a unidirectional spring biased pawl to engage the triangular notch in the attaching pin as it slides into the open head mode; and (h) a spring biased latch having a wedged head shaped to move the head of the latch outwards when it is moved axially forward against a fixed facing pin, one tooth thereon being disposed normal to the latch's axis shaped to bite radially into the peripheral ratchet teeth when the wrench's head is released into the open mode.

2. A wrench according to claim 1, where the elongated pin attached tangentially to the second semi-circular collar component has a solid cross-section, one side of the lower rectangular part of the pin having a plurality of notches along its entire length, a pinion wheel with compatible notches and a coaxial torsion spring engages the pin rack from below, winds up its torsion spring when the pin member is pushed into the slot in the first component, thus exerting an outward force on the inserted pin.

3. An open end ratcheting wrench comprising:

(a) a first fixed semi-circular channeled collar head member opening sideways along a linear path and attached radially to an elongated handle which is coaxial with the collar's diametrical chord;

(b) a second semi-circular channeled collar member that is a mirror-image of said first collar head, and is laterally movable between a closed head mode and an open head mode;

(c) a compression spring cartridge comprised of two hollowed tubes of the same length, each said tube being closed at its distal end and adapted to slide axially one inside the other, with an internal compression spring exerting an outward force on the two respective closed ends of the cartridge;

(d) a metal disc comprised of six identical 60 degree segments and having an outside perimeter, said metal disc being ratcheted on the outside perimeter to form a ratchet wheel, with an axial hexagonal slot of predetermined dimensions to substantially accurately circumscribe a standard-size nut;

(e) a spring-biased pawl pivoted to a pin adjacent said ratchet wheel to allow unidirectional rotation of said ratchet wheel, said pawl being shaped to block counter rotation thereof;

(f) means to disengage said spring-biased pawl from said ratchet wheel;

(g) an attaching pin extending generally adjacent to, and tangentially of said ratchet wheel;

(h) a unidirectional spring biased pawl positioned and adapted to engage a triangular notch in said attaching pin as said second semi-circular channeled collar head slides into the open head mode; and (i) a spring biased locking tab associated with said first fixed collar head member and arranged to enter a rectangular notch in said attaching pin when said first and second collar head members are in the closed mode for a tightening operation.

4. An open end ratcheting wrench comprising:

(a) a first fixed semi-circular channeled collar head member attached to an elongated handle which is coaxial with the diametrical chord of said collar, said collar head member adapted to open sideways along a linear path;

(b) a second semi-circular channeled collar member that is a mirror-image of said first collar head member and is laterally movable between a closed head mode and an open head mode;

(c) a compression spring cartridge comprised of two hollowed tubes of the same length, each said tube being closed at its distal end and adapted to slide axially one inside the other, with an internal compression spring exerting an outward force on the two closed ends of said cartridge;

(d) a metal disc having an outside perimeter, and being comprised of six identical 60 degree segments, said metal disc being ratcheted on the outside perimeter to form a ratchet wheel, and defining an axial hexagonal slot of predetermined dimensions to accurately circumscribe a standard-size nut;

(e) a pin located adjacent said metal disc, said pin defining a first notch on one side thereof, and a second notch on the opposite side thereof;

(f) a spring-biased pawl pivotably mounted adjacent said ratchet wheel to allow unidirectional rotation of said ratchet wheel, said pawl being dimensioned and configured to block counter rotation thereof;

(g) a unidirectional pawl in said first fixed semi-circular channeled collar head member positioned and adapted to engage said first notch in said pin to prevent the separation of said first and second collar members when said members are in the open mode; and (h) a spring-based locking tab in said first fixed semi-circular channeled collar head member positioned and adapted to engage said second notch in said pin to maintain said first and second collar head members in the closed mode during a tightening operation.

5. The open end ratcheting wrench according to claim 4, wherein said first notch in said pin is triangular in shape.

6. The open end ratcheting wrench according to claim 5, wherein said second notch on said pin is rectangular.

7. The open end ratcheting wrench according to claim 6, further comprising a pressure button comprised of two cylindrical parts of equal lengths which slide axially, one inside the other, and shaped to remain attached together.

8. The open end ratcheting wrench according to claim 7, further comprising a compression spring cartridge comprised of two hollowed tubes of the same length, each closed at its distal end and adapted to slide axially one inside the other, with an internal compression spring exerting an outward force on the two closed ends of said cartridge, said compression spring cartridge positioned inside said hollowed pin, and when fully compressed, said cartridge does not exceed in length that of the hollowed part of the pin, the open ends of the two hollowed tubes being shaped to prevent their separation when the cartridge is fully extended.

* * * * *